US008662351B2

(12) United States Patent
Kalaouze

(10) Patent No.: US 8,662,351 B2
(45) Date of Patent: Mar. 4, 2014

(54) SUPPLEMENTAL LIQUID STORAGE DEVICE ATTACHABLE TO A PRIMARY BEVERAGE CONTAINER

(71) Applicant: Fadi Kalaouze, College Station, TX (US)

(72) Inventor: Fadi Kalaouze, College Station, TX (US)

( * ) Notice: Subject to any disclaimer, the term of this patent is extended or adjusted under 35 U.S.C. 154(b) by 0 days.

(21) Appl. No.: 13/758,980

(22) Filed: Feb. 4, 2013

(65) Prior Publication Data

US 2013/0146592 A1 Jun. 13, 2013

Related U.S. Application Data

(63) Continuation-in-part of application No. 12/496,502, filed on Jul. 1, 2009, now Pat. No. 8,365,960, and a continuation-in-part of application No. 13/684,568, filed on Nov. 25, 2012.

(51) Int. Cl.
*B67D 7/78* (2010.01)

(52) U.S. Cl.
USPC ..... 222/145.5; 222/166; 222/153.07; 222/570; 426/115; 206/222; 206/229; 215/45; 215/902; 220/271; 220/712; 220/713; 220/501

(58) Field of Classification Search
USPC ..... 215/43–46, 254, 902; 220/90.2, 90.4, 220/90.6, 271, 711–714, 23.83, 501; 222/129, 145.1, 145.5, 160, 164–166, 222/79, 567, 569–570, 153.07; 426/115; 206/222, 229
See application file for complete search history.

(56) References Cited

U.S. PATENT DOCUMENTS

| | | | | | |
|---|---|---|---|---|---|
| 3,116,855 | A * | 1/1964 | Thomson | 222/207 |
| 3,335,893 | A * | 8/1967 | Hanson | 215/254 |
| 3,851,800 | A * | 12/1974 | Swain | 222/145.1 |
| 4,576,306 | A * | 3/1986 | Kelsey et al. | 220/271 |
| 4,579,257 | A * | 4/1986 | Brandlein | 222/192 |
| 5,071,042 | A * | 12/1991 | Esposito | 222/570 |
| 6,540,112 | B1 * | 4/2003 | Studnik | 222/132 |
| 2007/0138179 | A1 * | 6/2007 | Jacobs et al. | 220/254.9 |

* cited by examiner

*Primary Examiner* — Paul R Durand
*Assistant Examiner* — Andrew P Bainbridge
(74) *Attorney, Agent, or Firm* — Mark Young, P.A.

(57) ABSTRACT

A secondary container assembly includes a skirt configured to securely and removably engage the rim of a beverage can. The secondary container includes a secondary compartment holding a secondary liquid. A primary flow channel extends through the secondary container to provide a fluid flow path from the open beverage can to an outlet of the secondary container. A plurality of mixing apertures provide fluid communication ports between the secondary compartment and the primary flow channel, allowing the secondary liquid to mix with beverage from the can in the primary flow channel. A vent tube prevents a vacuum from forming that would otherwise impede flow of the secondary liquid into the primary flow channel. A removable seal covers the outlet and mixing ports. A threaded lid holds the seal in place.

14 Claims, 15 Drawing Sheets

SUPPLEMENTAL LIQUID STORAGE DEVICE ATTACHABLE TO A PRIMARY BEVERAGE CONTAINER

RELATED APPLICATION

This application is a continuation-in-part and claims the benefit of priority of U.S. Nonprovisional application Ser. No. 12/496,502 filed Jul. 1, 2009 , which is now U.S. Pat. No. 8,365,960, and U.S. Nonprovisional application Ser. No. 13/684,568 filed Nov. 25, 2012, the entire contents of which are incorporated herein by this reference and made a part hereof.

FIELD OF THE INVENTION

This invention relates to containers, and, in particular, to a secondary container attachable to a primary beverage container such as a beverage can or bottle.

BACKGROUND

People the world over consume mixed drinks—sometimes such drinks are a mixture of alcoholic and nonalcoholic beverages, carbonated and non-carbonated beverages, flavorings and water, nutritional supplements and water, or any combination of fluids and/or fluid compatible ingredients. Sometimes the combination of such ingredients may produce an unsavory flavor if they are mixed with one another for some extended period of time. One component may settle, absorb carbonation or otherwise react with the other components. Usually, the flavor of these mixed drinks is optimized by consuming the beverage immediately after mixing the constituents. As a result, the component fluids are usually kept in separate containers until they are mixed.

For example, when a beverage such as a wine spritzer is mixed, the wine and carbonated beverage are mixed only immediately before consumption. Otherwise, the adverse effect of the wine and carbonated beverage when they are combined for some extended period of time would render the drink unpalatable. The wine often acquires a bitter taste, while the carbonated beverage becomes "flat." The same general effects are observed as an alcoholic beverage such as rum is mixed with cola or fruit juice.

Because of the adverse effects associated with the extended mixing of certain components of common mixed drinks, these components are often stored separately until immediately before consumption. Individuals must therefore mix drinks. Not only is such mixing tedious, but the process is inherently imprecise, resulting in some drinks that are much stronger or weaker than others. Additionally, the ingredients are stored separately and tend to be depleted at different times, making it difficult to maintain an inventory of adequate amounts of all constituents of a mixed drink.

Recognizing the advantages that a multi-compartment container would provide, innovators have conceived various dual chamber containers over the years. However, known prior multi-compartment containers do not address the unique conveniences inherent in the present invention. In the art, there is no known container that is attachable to conventional beverage containers, keeps constituents in discrete hermetically sealed compartments, opens both compartments simultaneously with removal of a cap and gasket, and enables pouring and mixing of determined proportions of each liquid simultaneously through separate but adjacent orifices.

What is needed is a supplementary beverage container that is attachable to conventional beverage containers, is capable of keeping its constituents in a discrete hermetically sealed compartment, provides openings for the beverage container and the compartment of the supplementary container, and facilitates pouring, proportioning and mixing of the constituents after opening and during consumption. The invention is directed to overcoming one or more of the problems and solving one or more of the needs as set forth above.

SUMMARY OF THE INVENTION

A secondary container assembly includes a skirt configured to securely and removably engage the rim of a beverage can. The secondary container includes a secondary compartment holding a secondary liquid. A primary flow channel extends through the secondary container to provide a fluid flow path from the open beverage can to an outlet of the secondary container. A plurality of mixing apertures provide fluid communication ports between the secondary compartment and the primary flow channel, allowing the secondary liquid to mix with beverage from the can in the primary flow channel. A vent tube prevents a vacuum from forming that would otherwise impede flow of the secondary liquid into the primary flow channel. A removable seal covers the outlet and mixing ports. A threaded lid holds the seal in place.

An exemplary supplemental beverage container includes a body defining an interior compartment for containing a supplemental liquid. The body has a top, a bottom and a sidewall extending from the top to the bottom. A top opening at the top of the body, a bottom opening at the bottom of the body, and a conduit extending from the bottom opening at the bottom of the body to the top opening at the top of the body are provided. The conduit defines a fluid flow path from the bottom opening at the bottom of the body to the top opening at the top of the body. The opening at the bottom of the body is in fluid communication with a primary beverage container when the primary beverage container is opened and attached to the supplemental beverage container.

An aperture is provided in the conduit. The aperture provides fluid communication between the interior compartment of the supplemental beverage container and the conduit.

A container attachment (e.g., a means for attachment to either a can or bottle) is provided at the bottom of the body. The container attachment is configured to removably attach the supplemental beverage container to a primary beverage container (e.g., a can or bottle).

A vent port is provided in the body. The vent port provides venting for the interior compartment. A vent tube has a first end and an opposite second end. The first end is attached to the vent port. The second end is in the interior compartment adjacent to the bottom of the body in the interior compartment.

A sealable fill port is provided in the body. The sealable fill port is a sealable aperture in the bottom of the bottom of the body. The fill port provides a fluid pathway into the interior compartment.

An optional guide pin extends from the bottom of the body outside of the interior compartment. The pin is configured to engage an opening in the primary container.

A removable seal has a first portion configured to extend into the conduit and cover the aperture and a second portion configured to extend to and cover the vent port. The removable seal may be an elastomeric gasket. The top of the body includes a threaded collar and a removable threaded cap that engages the threaded collar when attached to the collar. The cap secures the first portion of the removable seal in the conduit and on the aperture and the second portion of the removable on the vent port, when the cap is attached to the collar.

The primary beverage container may be a beverage can with a top rim. The container attachment of the supplemental beverage container at the bottom of the body includes a flexible skirt having a divergent opening and a snap-fit superior section with a shoulder configured to engage the top rim of the beverage can.

Alternatively, the primary beverage container may be a beverage bottle with a top threaded neck. The container attachment of the supplemental beverage container at the bottom of the body includes a threaded female opening configured to threadedly receive and engage the top threaded neck of the beverage bottle.

The aperture in the conduit is sized to regulate fluid flow through the aperture to achieve a determined flow rate. The aperture in the conduit may be one of a plurality of apertures in the conduit, each of which provides fluid communication between the interior compartment of the supplemental beverage container and the conduit. The plurality of apertures are sized to regulate fluid flow through the apertures to achieve a determined flow rate.

In another embodiment, the container has an interior compartment for containing a supplemental liquid. The container has a top, an open bottom and a sidewall extending from the top to the open bottom, and a top opening at the top of the body. A base assembly is attached to container. The base assembly covers the open bottom of the container. A bottom opening is provided in the base assembly. A conduit extends from the bottom opening to the top opening at the top of the body. The conduit defines a fluid flow path from the bottom opening to the top opening at the top of the body. A container attachment is attached to (e.g., connected to or integrally formed with) the base assembly. The container attachment is configured to removably attach the base assembly to a primary beverage container. The bottom opening is in fluid communication with the primary beverage container when the primary beverage container is opened and attached to the base assembly.

An aperture is provided in the conduit. The aperture provides fluid communication between the interior compartment of the supplemental beverage container and the conduit. The aperture in the conduit is sized to regulate fluid flow through the aperture to achieve a determined flow rate.

A vent port is provided in the body. The vent port provides venting for the interior compartment. A vent tube has a first end and an opposite second end. The first end is attached to the vent port and the second end is in the interior compartment adjacent to the base assembly.

A sealable fill port is provided in the base assembly. The fill port provides a fluid pathway into the interior compartment.

A removable seal has a first portion configured to extend into the conduit and cover the aperture and a second portion configured to extend to and cover the vent port, the removable seal includes an elastomeric gasket. The top of the body includes a threaded collar and a removable threaded cap. The cap threadedly engages the threaded collar when attached to the collar. The cap secures the first portion of the removable seal in the conduit and on the aperture and the second portion of the removable on the vent port, when the cap is attached to the collar.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes, ornamental aspects or proportions shown in the figures.

DETAILED DESCRIPTION

Figure 1:
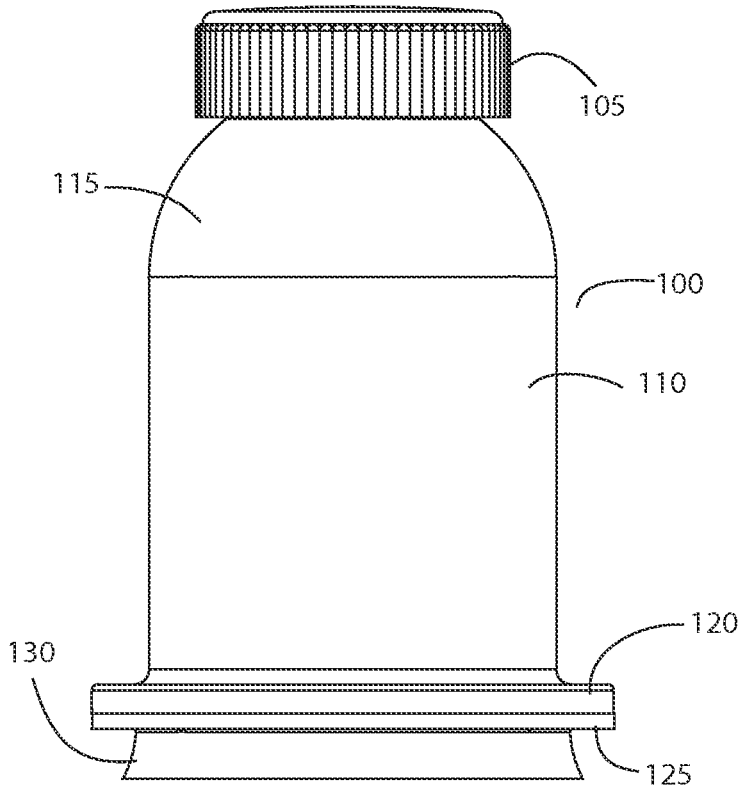
FIG. 1 provides a side view of an exemplary supplemental beverage container according to principles of the invention.
Figure 2:
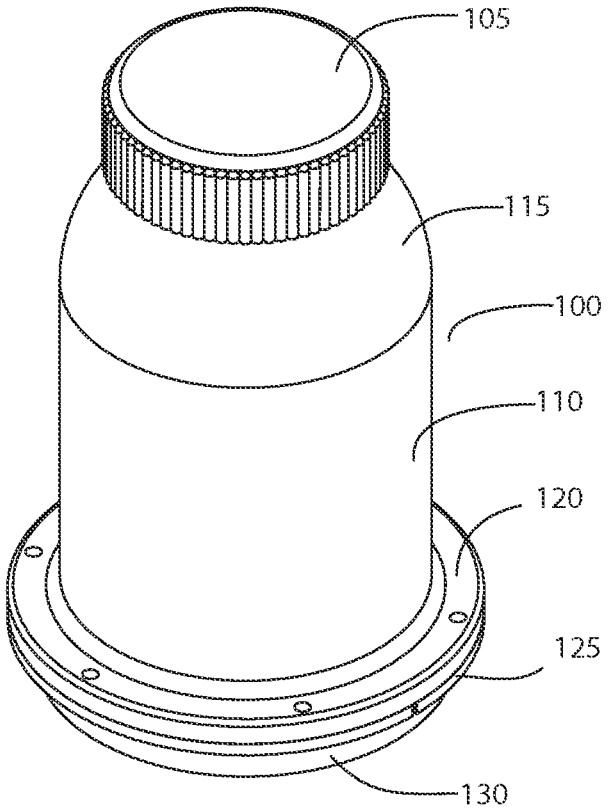
FIG. 2 provides a perspective view of an exemplary supplemental beverage container according to principles of the invention.

Referring to the side and perspective views of FIGS. 1 and 2, respectively, a secondary or supplemental beverage container 100 is shown. The container 100 is configured for attachment to the top of a beverage can, as discussed and shown below. The container 100 includes a removable threaded cap 105 a cylindrical body 110 with a domed top 115, a flanged bottom 120 attached to a flanged base 125, and a skirt 130. The skirt receives and grips the top rim of as beverage can, as discussed and shown below. The flanged base 125 attaches to the flanged bottom 120. The body 110 and top 115 define a compartment for containing a secondary or supplemental beverage as well as other components of the container 100.

Figure 3:
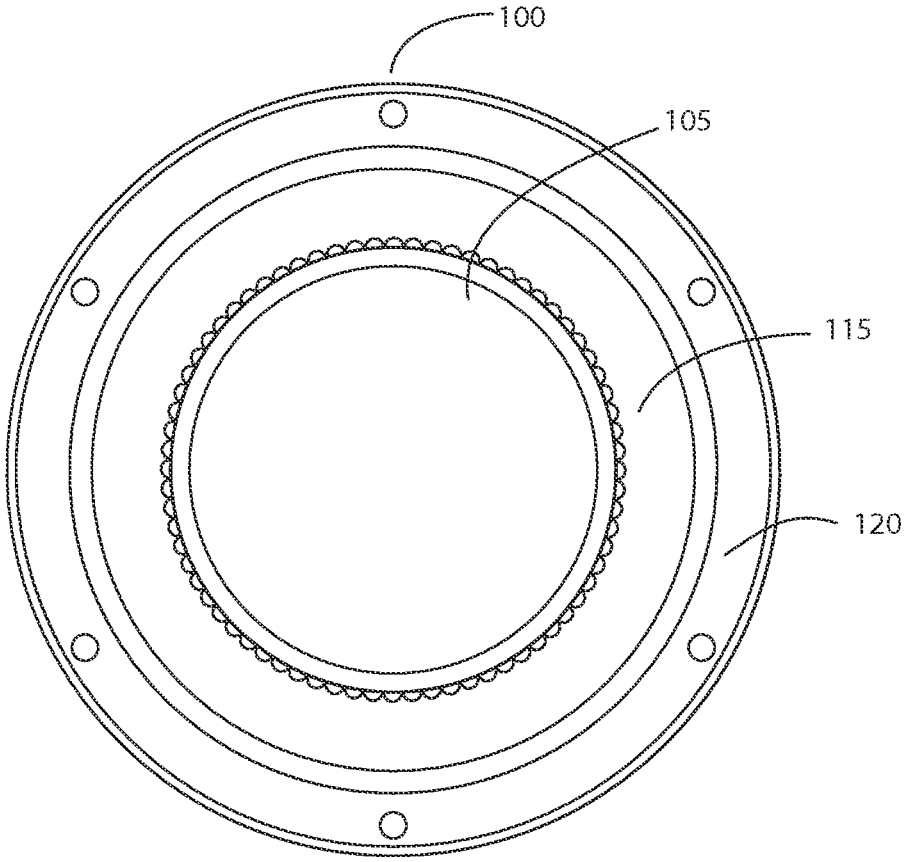
FIG. 3 provides a plan view of an exemplary supplemental beverage container according to principles of the invention.

In the top view of FIG. 3, the threaded cap 100 and cylindrical body are shown as concentric. However, the invention is not limited to concentric alignment. Rather, other non-concentric alignments are possible and come within the scope of the invention.

Figure 4:
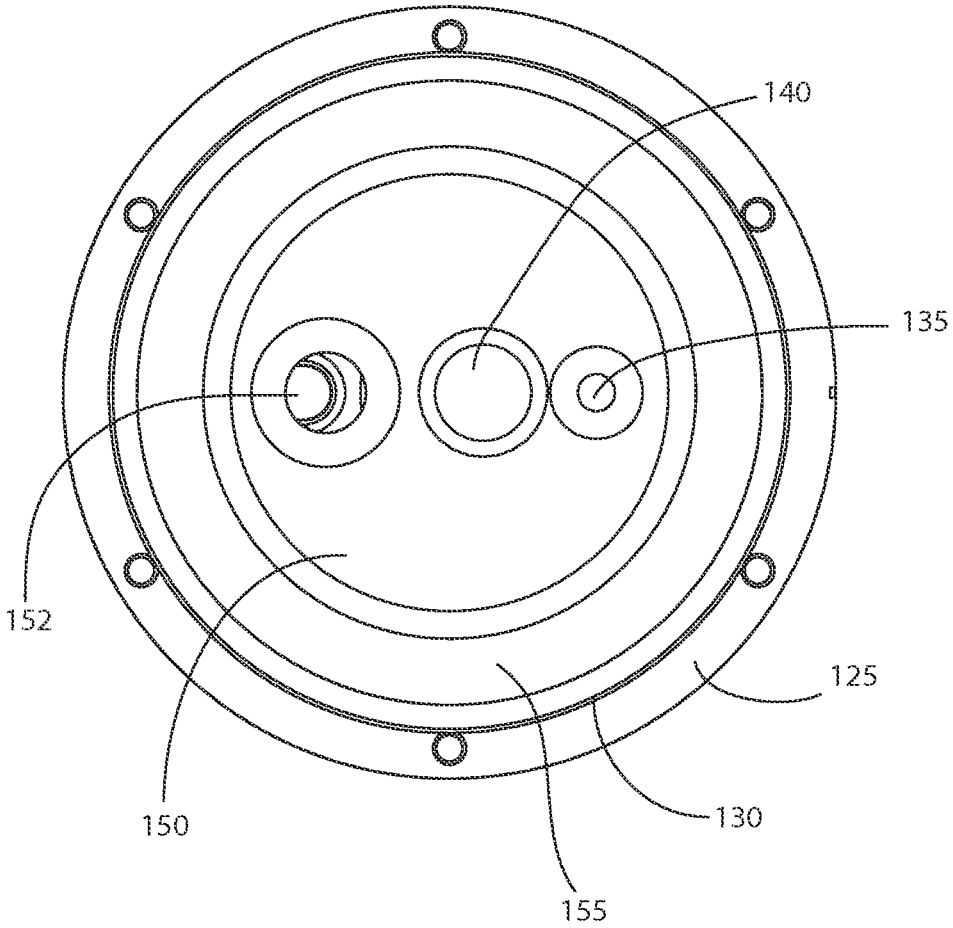
FIG. 4 provides a bottom view of an exemplary supplemental beverage container according to principles of the invention.
Figure 5:
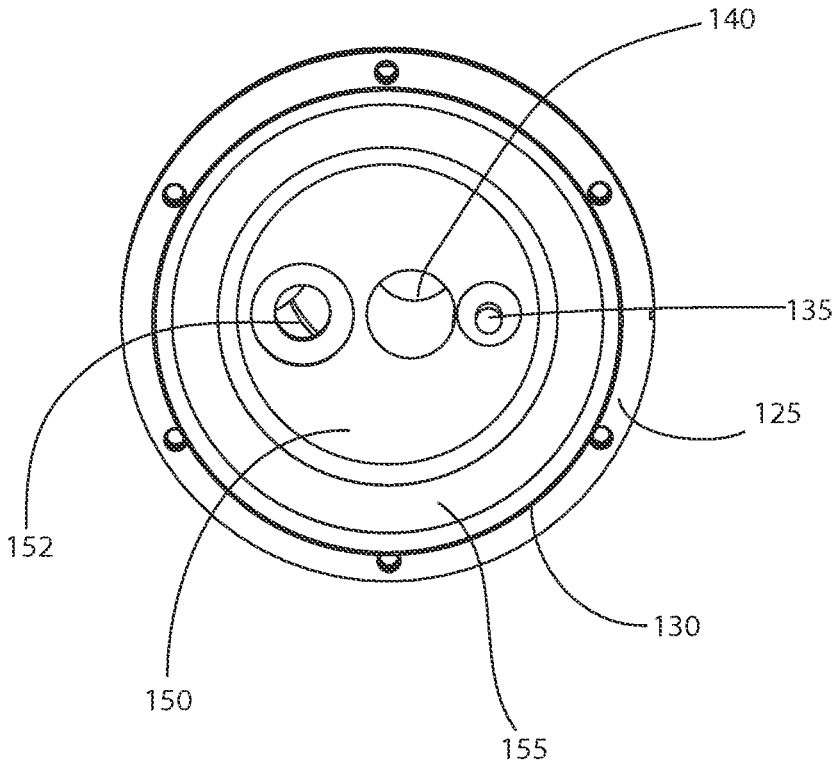
FIG. 5 provides a bottom perspective view of an exemplary supplemental beverage container according to principles of the invention.

The bottom perspective views of FIGS. 4 and 5 shows a fill port 152, a primary beverage conduit 140 and a guide pin 135. The bottom includes a superior compartment 150 integrally coupled to an inferior compartment 155 defined by the skirt 130. The inferior compartment 155 receives the top rim of a beverage can, as discussed below. The superior compartment 150 provides a space into which the primary beverage may flow. The superior compartment 150 is fluidly coupled with the primary beverage conduit 140, through which the primary fluid may flow. The pin 135 is configured to engage the opening in an open flip-tab beverage can, thereby ensuring proper alignment of the container 100 with the beverage can.

A fill port 152 is provided for filling the supplemental beverage container 100. After the supplemental beverage container 100 is filled, the fill port 152 may be sealed using any compatible fluid seal. By way of example and not limitation, an elastomeric (e.g., silicone) plug, secured by tape may be used to seal the fill port 152. Alternatively, a tape may be used alone to seal the fill port 152. As another alternative, a threaded plug with or without a gasket may be received by the fill port 152 to provide a seal.

Figure 6:
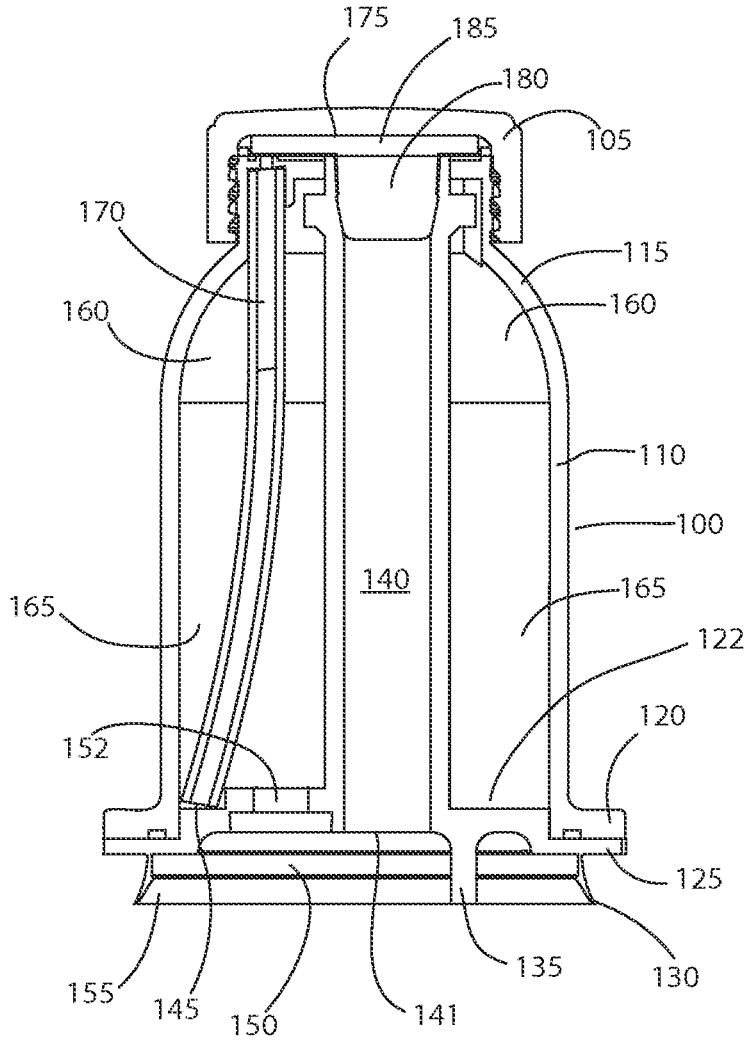
FIG. 6 provides a section view of an exemplary supplemental beverage container according to principles of the invention.
Figure 7:
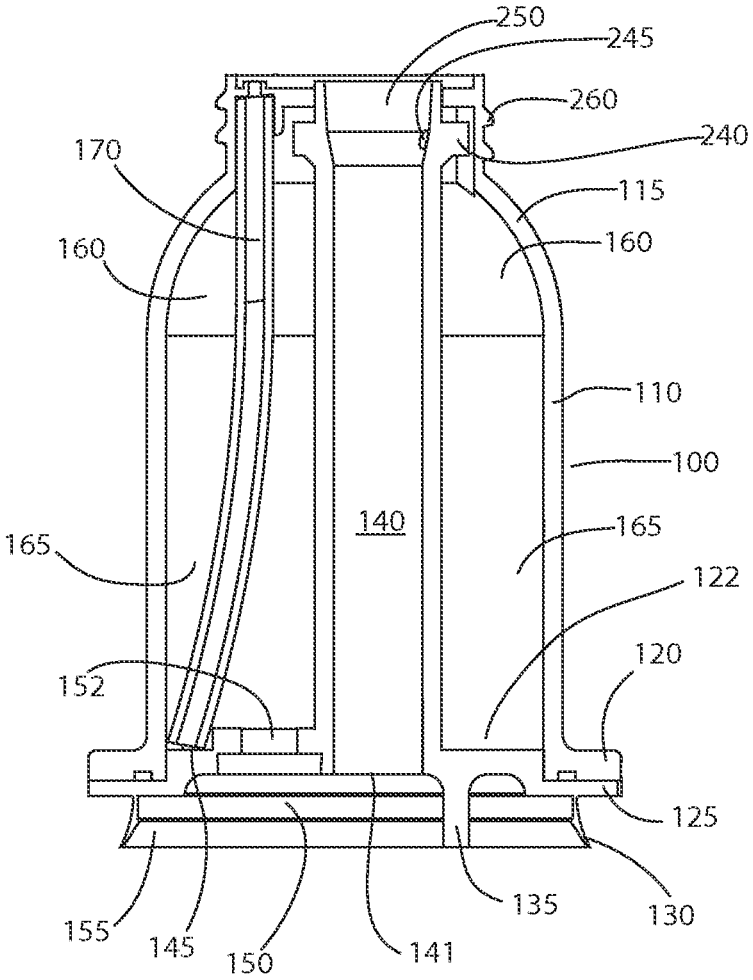
FIG. 7 provides a section view of an exemplary supplemental beverage container without a top cap according to principles of the invention.

Referring now to the section view of FIGS. 6 and 7, the base assembly 122 attaches to the flanged bottom 120 and forms the bottom of the supplemental beverage container 100. While the body 110 and top 115 define a compartment for containing a secondary or supplemental beverage as well as other components of the container 100, the base assembly 122 provides means for engaging the top rim of a can, directing fluid from an engaged can to the neck 260 (i.e., threaded collar) of the supplemental beverage container 100, and allowing mixing of the secondary beverage with the primary beverage.

The primary beverage conduit 140 projects upwardly from the base assembly 122 and extends through the compartments 160, 165, of the supplemental beverage container 100. The primary beverage conduit 140 provides a fluid path for a liquid beverage to flow from a can, through the compartments 160, 165 and to the neck 260 of the supplemental beverage container 100. The diameter and cross-sectional shape of the primary beverage conduit 140 allow a sufficient amount of the primary beverage to flow from the can to the neck 260 of the supplemental beverage container 100, without occupying excessive volume in the compartments 160, 165. A plurality of ports or apertures 245 known as mixing apertures or metering apertures are provided in the head 250 of the primary beverage conduit 140, through a collar 240. The collar 240 is integrally formed adjacent to the head 250 of the conduit 140. The head 250 of the primary beverage conduit 140 diverges to accommodate the secondary beverage introduced via the apertures 245 into the primary beverage flowing through the primary beverage conduit 140. The divergent head 250 facilitates mixing of the secondary beverage introduced via the apertures 245 into the primary beverage flowing through the primary beverage conduit 140. The number, size and configuration of the apertures 245 may be varied to attain a desired mixing ratio and time. As the apertures 245 are formed in the divergent portion of the head 250, the apertures 245 are angled to face the opening at the head 250, which facilitates mixing. The bottom end 141 of the primary beverage conduit 140 is formed in the base assembly 122, and provides an aperture through which the primary beverage flowing from a can may enter the primary beverage conduit 140.

The fill port 152 provides an access port for filling the compartments 160, 165. Before the supplemental beverage container 100 is mated with a beverage can, the secondary liquid beverage is introduced into the compartments 160, 165 through the fill port 152 of the supplemental beverage container 100. Then the fill port 152 is sealed, as discussed above. Thus, the supplemental beverage container 100 with the contained secondary liquid beverage may be mated with a can. While the fill port 152 is shown on the base assembly 122 at the bottom of the supplemental beverage container 100, it should be appreciated that the fill port may be positioned at other locations on the supplemental beverage container 100, such as at the neck 260.

A vent tube 170 extends from a tube holder 145 in the base assembly 122 to a port at the neck 260 of the supplemental beverage container 100. The vent tube 170 prevents vacuum buildup from preventing the flow of the secondary liquid through the apertures 245 during use. Without the vent tube, a vacuum may form that severely impedes flow of the secondary liquid through the apertures 245 during use. The opening at the bottom end of the vent tube 170 is not covered when held by the holder 145. As shown in FIG. 7, the tube 170 has a length that extends from the holder 145 to a port at the neck 260, without forcing the bottom opening against a surface. The bottom opening of the vent tube 170 is held at an angle relative to the base assembly 122. It is important that both ends of the vent tube remain unblocked, with one end exposed to the atmosphere and the other end in the compartment 165. Because the bottom of the vent tube 170 is cut straight across and held at an angle relative to the base assembly 122, the opening is exposed to the compartment 165. When the supplemental beverage container 100 is tipped for pouring or drinking, the secondary beverage flows towards the domed top 115 and the held end of the tube 170 tends to extend above the level of the secondary beverage in the supplemental beverage container 100. The tube 170 thus provides a passage for air from a port at the neck 260 to the holder 145 at the base assembly 122.

Figure 8:
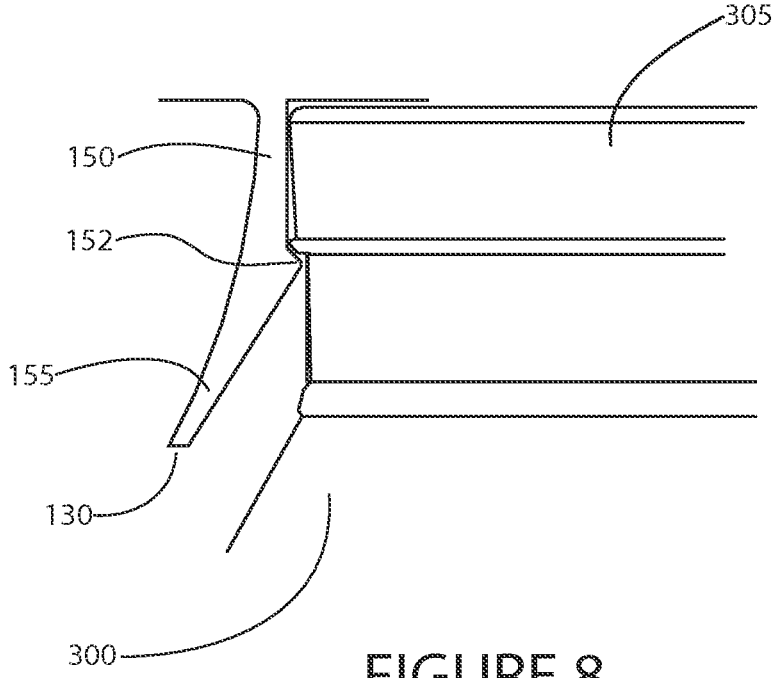
FIG. 8 provides a schematic of an exemplary skirt of a supplemental beverage container engaging the top rim of a can according to principles of the invention.

The base assembly 122 also includes a skirt 130 for mounting atop a beverage can. The skirt 130 includes a divergent opening 155 and a snap-fit superior section 150. As shown in FIG. 8, the skirt 130 includes a shoulder 152 configured to engage the top rim 305 of a conventional beverage can 300. The skirt 130 is flexible and resilient. The snap-fit superior section 150 is sized and configured to snugly receive the top rim 305 of a beverage can 300. When urged on top of a beverage can 300, the skirt 130, including the shoulder 152, flex outwardly until the rim 305 of the can is received in the snap-fit superior section 150. When received by the snap-fit superior section 150, the rim 305 is securely engaged by the skirt 130. The material of the skirt 130 is supple, pliant and adaptable, to a secure seal when the rim 305 is received by the snap-fit superior section 150. An exemplary material may comprise silicone, other rubber-like elastomers, or other supple and resilient plastics.

Figure 9:
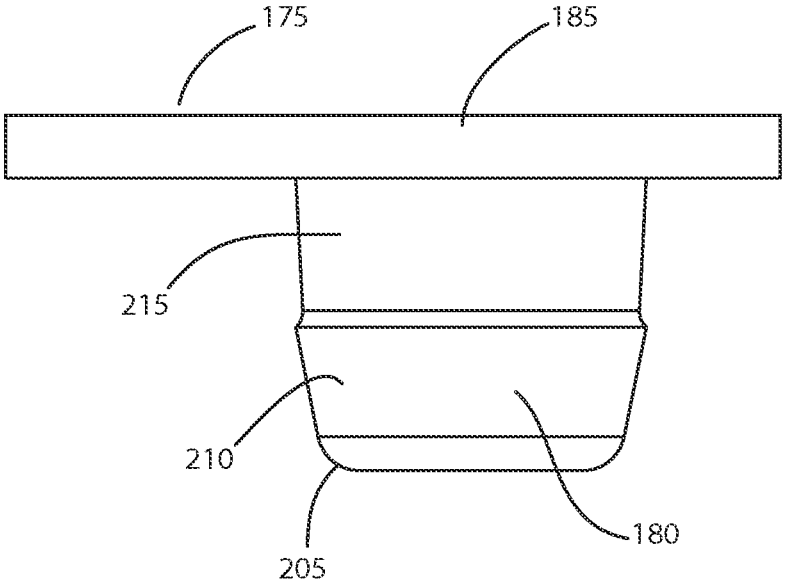
FIG. 9 provides a side view of an exemplary seal for a supplemental beverage container according to principles of the invention.
Figure 10:
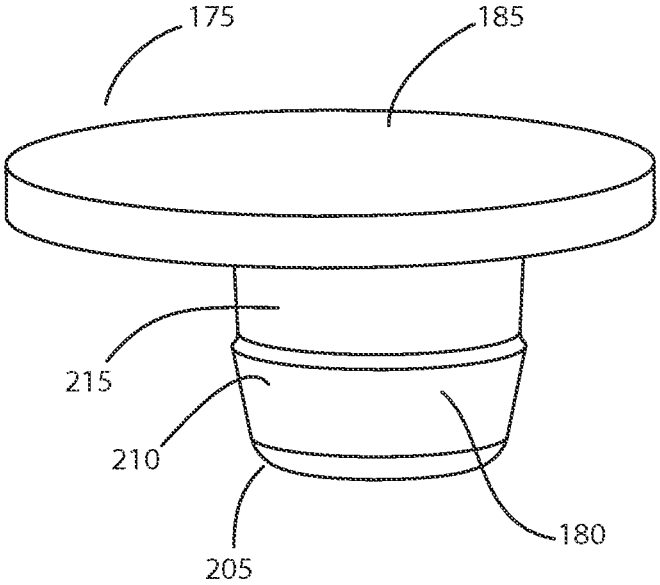
FIG. 10 provides a perspective view of an exemplary seal for a supplemental beverage container according to principles of the invention.

Referring now to FIGS. 9 and 10, a removable seal 175 is shown. The seal 175 prevents leakage of liquid beverages from the primary beverage conduit 140, the plurality of apertures 245 provided in the head 250 of the primary beverage conduit 140, and the port 275 to which the vent tube 170 connects. The seal 175 is configured to reside between the threaded cap 105 and the top surface 265 of the threaded neck 260. When the cap is threadedly fastened and fully tightened to the neck 260, the seal is pressed securely in place. The planar top 185 of the seal 175 covers the port 275 to which the vent tube 170 connects. The planar top 185 of the seal 175 also covers the primary opening 270 which is connected to the head 250 of the primary beverage conduit 140. The seal 175 includes an aperture seal 180 comprised of a neck 215 and head 210 projecting from the planar top 185. The neck 215 is configured to extend through the primary opening 270 which is connected to the head 250 of the primary beverage conduit 140. The sealing head 210 is shaped and sized to fill and seal the head 250 of the primary beverage conduit 140. In so doing, the sealing head 210 covers and seals off the apertures 245. The leading edge 205 of the sealing head 210 is filleted, beveled or chamfered to facilitate entry of the sealing head 210 into the head 250 of the primary beverage conduit 140.

The seal 175 may be comprised of any food-safe elastomeric material, such as silicon, rubber or similar natural or synthetic polymers suitable for gaskets or o-rings. The seal 175 is sized to fit between the top of threaded neck 260 and the cap 105. The seal 175 may be compressible and, therefore, sized slightly larger than the available space. In such case, the seal 175 may be urged in place by compression.

Figure 11:
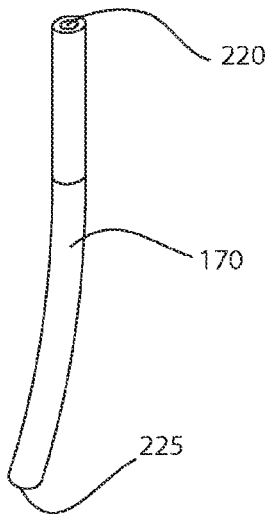
FIG. 11 provides a perspective view of an exemplary vent tube for a supplemental beverage container according to principles of the invention.

In FIG. 11, an exemplary vent tube 170 is shown. The vent tube 170 fluidly couples a vent port 275 with the interior compartment 165 adjacent to the base assembly 122. When the supplemental beverage container 100 is tipped for drinking or pouring, the secondary liquid beverage contents flow towards the portion of the interior compartment 160 near the neck 260. One end 220 of the vent tube connects to an outlet such as vent port 275. The opposite end 225 is held next to the base assembly 122 by the vent tube holder 145. It is important that this end remain substantially unimpeded. The end 225 may be cut straight provided that it is not fixed flush against a surface that substantially impedes flow. Alternatively, the end 225 may be cut at an angle or be perforated to ensure free flow of air through the tube 170. Without a vent, a vacuum might form behind the flowing liquid. Such a vacuum would impede flow of the secondary liquid beverage through the mixing apertures 245. The vent tube 170 allows air to fill the space in the compartments 160, 165 between the secondary liquid beverage and the base assembly 122.

Figure 12:
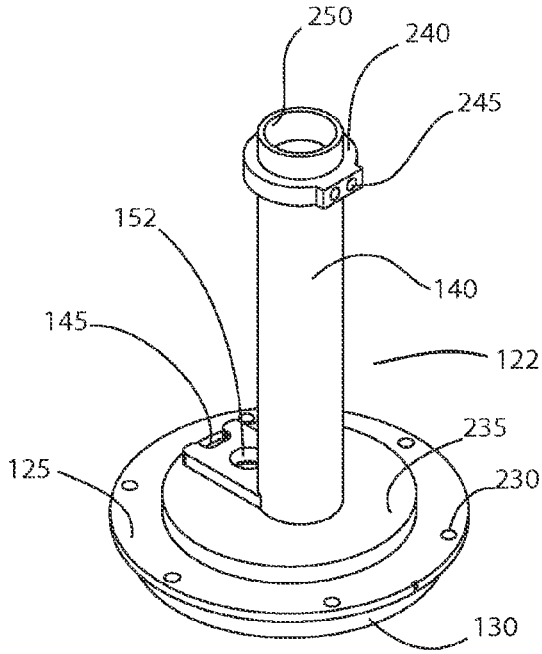
FIG. 12 provides a perspective view of an exemplary base assembly for a supplemental beverage container according to principles of the invention.
Figure 13:
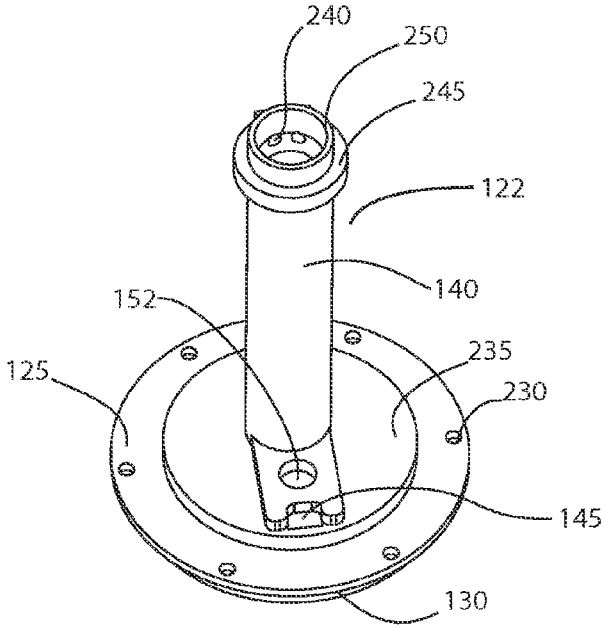
FIG. 13 provides another perspective view of an exemplary base assembly for a supplemental beverage container according to principles of the invention.

The base assembly 122 is shown in FIGS. 12 and 13. The base assembly 122 serves several functions. It provides a bottom closure 125, 235 for the supplemental beverage container 100, a skirt 130 for attachment to the top of a beverage can, a fill port 152, a tube 140 through which a primary beverage flows, apertures 145 for mixing the secondary beverage with the primary beverage, and a holder 145 for the vent tube 170.

The base 125 attaches to the flanged bottom 120 of the cylindrical body 110. A shallow base assembly foundation 235 is sized and shaped to fit snugly into the compartment 165 through the bottom opening of the cylindrical body 110. This fit provides a good leak-proof seal. The base may be attached to the flanged bottom 120 of the cylindrical body 110 by bonding, welding or any other method of leak-proof plastic attachment.

The primary beverage conduit 140 projects upwardly from the base assembly foundation 235. The primary beverage conduit 140 provides a fluid channel for a primary liquid beverage to flow from a can, through the compartments 160, 165 and to the neck 260 of the supplemental beverage container 100. The diameter and cross-sectional shape of the primary beverage conduit 140 allow a sufficient amount of the primary beverage to flow from the can to the neck 260 of the supplemental beverage container 100, without occupying excessive volume in the compartments 160, 165. A plurality of mixing apertures 245 are provided in the head 250 of the primary beverage conduit 140, through a collar 240. The collar 240 is integrally formed adjacent to the head 250 of the conduit 140. The collar provides a structure that can be easily gripped or clamped for mounting. The head 250 of the primary beverage conduit 140 diverges to accommodate the secondary beverage introduced via the apertures 245 into the primary beverage flowing through the primary beverage conduit 140. The divergent head 250 facilitates mixing of the secondary beverage introduced via the apertures 245 into the primary beverage flowing through the primary beverage conduit 140. The number, size and configuration of the apertures 245 may be varied to attain a desired mixing ratio and time. As the apertures 245 are formed in the divergent portion of the head 250, the apertures 245 are angled to face the opening at the head 250, which facilitates mixing. The bottom end 141 of the primary beverage conduit 140 is formed in the foundation base assembly 122, and provides an aperture through which the primary beverage flowing from a can may enter the primary beverage conduit 140. Flanged bottom 120 attached to a flanged base 125, and a skirt 130. The skirt receives and grips the top rim of as beverage can, as discussed and shown below.

The bottom perspective views of FIGS. 4 and 5 shows a fill port 152, a primary beverage conduit 140 and a guide pin 135. The bottom includes a superior compartment 150 integrally coupled to an inferior compartment 155 defined by the skirt 130. The inferior compartment 155 receives the top rim of a beverage can, as discussed below. The superior compartment 150 provides a space into which the primary beverage may flow. The superior compartment 150 is fluidly coupled with the primary beverage conduit 140, through which the primary fluid may flow. The pin 135 is configured to engage the opening in an open flip-tab beverage can.

As discussed above, the vent tube 170 extends from a tube holder 145 in the base assembly 122 to a port at the neck 260 of the supplemental beverage container 100. The tube holder 145 is a generally u-shaped slot into which an end 225 of the vent tube 170 is removably retained. Other tube positioning and/or retaining devices may be utilized within the scope of the invention. The purposes of the holder 145 are stabilization and positioning. Stabilization is important. Failure to stabilize (e.g., secure) the tube 170 risks excessive movement and separation from the vent port 275 during transport and use. Positioning ensures that the end 225 of the tube 170 is located and oriented in a manner that does not substantially impede free flow through the end 225 of the tube 170 and to the opposite end 220 vent port 275.

The flanged bottom 120 attaches to the flanged base 125 using any suitable plastic attachment methods that provide a leak-proof seal, such as bonding, welding or mechanical fastening. In the case of mechanical fastening, mating male and female engaging features 230, 232 (FIG. 14) may be provided on the flanged bottom 120 and the flanged base 125. Bonding and/or welding may be used in addition to mechanical fastening.

Figure 14:
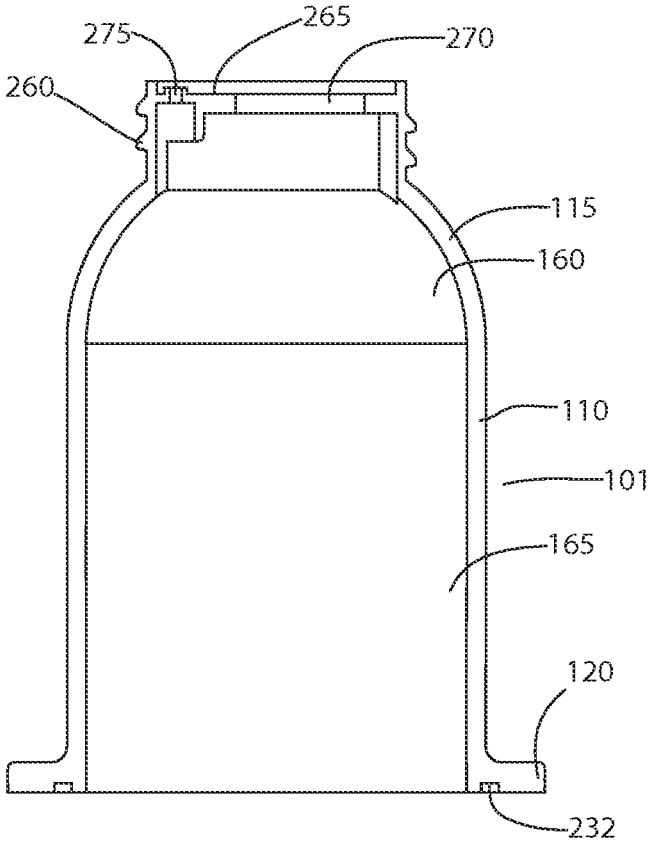
FIG. 14 provides a section view of an exemplary housing of a supplemental beverage container according to principles of the invention.
Figure 15:
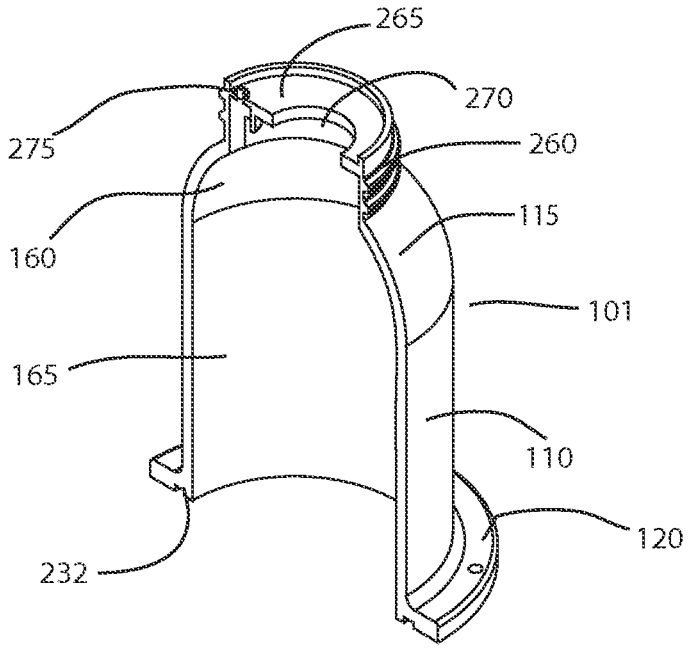
FIG. 15 provides a perspective view of a section of an exemplary housing of a supplemental beverage container according to principles of the invention.
Figure 16:
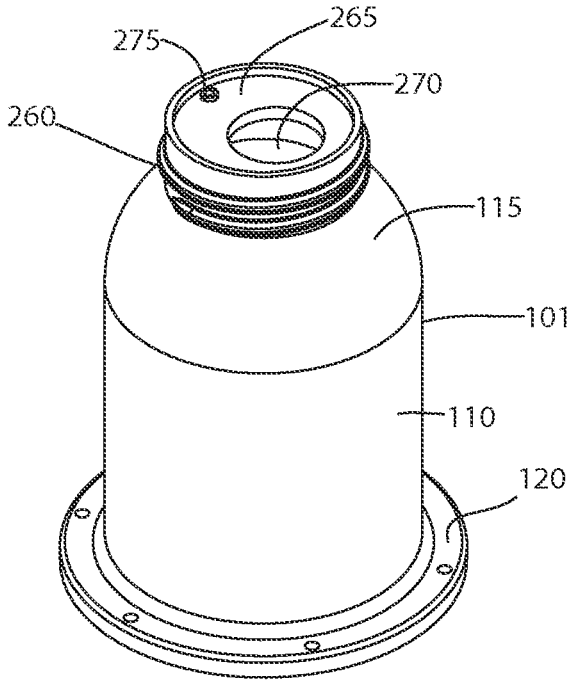
FIG. 16 provides a perspective view of an exemplary housing of a supplemental beverage container according to principles of the invention.

FIGS. 14, 15 and 16 show the housing 101 that mates with the base assembly 122, which together define the secondary or supplemental beverage container 100. The housing 101 includes a cylindrical body 110 with a domed top 115, a flanged bottom 120, and a threaded neck 260. A top surface 265 extends across a portion of the top of the threaded neck 260. The primary opening 270 and vent port 275 are formed in the top surface 265. The cylindrical body 110 and domed top 115 define an integral interior compartment comprised of a cylindrical compartment section 165 and a domed compartment section 160. The interior compartment, comprised of the cylindrical compartment section 165 and the domed compartment section 160, defines a volume in which the secondary beverage is contained.

Figure 17:
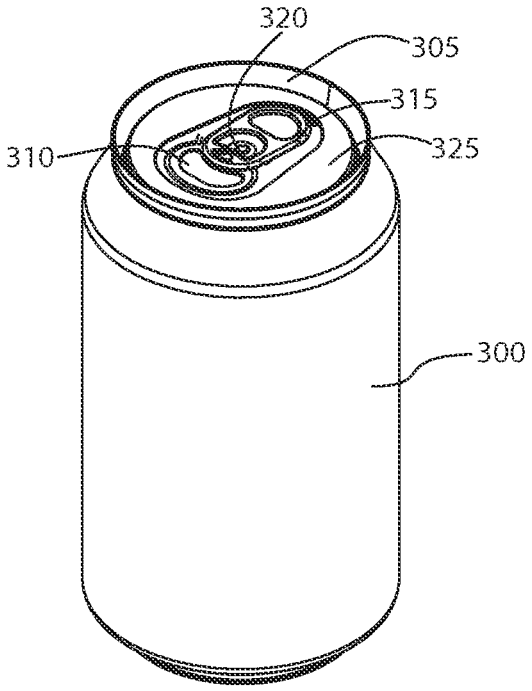
FIG. 17 provides a perspective view of an exemplary beverage can for use with a supplemental beverage container according to principles of the invention.

With reference to FIG. 17, a beverage container according to principles of the invention is comprised primarily of a beverage can, and, in a particular preferred embodiment an aluminum beverage can. The can is produced in a conventional manner, for example, starting with a thin sheet of aluminum that is cut into a circle, called a blank. The blank forms the bottom and sides of the can. After the circular blank is cut, it is drawn, pulled and pressed into a cup 300 having an open compartment, bottom and cylindrical sidewall. After the cup is formed, a punch presses up against the base (i.e., the bottom), causing the bottom to bulge inward. This concavity counteracts the pressure of carbonation contained in the can 300. Afterwards the top edges of the cylindrical sidewall are trimmed, leaving the upper walls straight and level. The can 300 may then be cleaned and imprinted with a label. After the can 300 is decorated, it is squeezed in slightly at the top to a make a neck, and the neck is given an outward flange at the very top edge, which will be folded over once a lid is added. A lid 325 is cut to a diameter for attachment to the walls of the container. The center of the lid 325 is stretched upward slightly and drawn to form a rivet 320. A pull tab 315 is inserted on the rivet and secured by it. Then the lid 325 is scored in a generally elliptical or oval path that defines a separable panel, referred to herein as a tongue 310. When the tab 315 is pulled by a consumer, scored edges of the tongue 310 will detach easily, allowing the tongue to bend downwardly into the can 300 and leave a proper opening. A folded or rolled rim 305 defining the periphery of the lid is configured to engage the top edges of the can 300.

Figure 18:
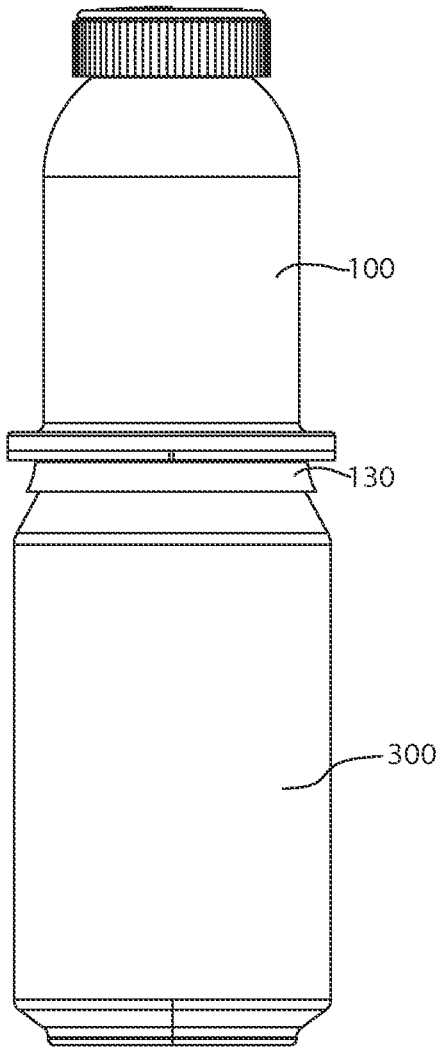
FIG. 18 provides a side view of an exemplary supplemental beverage container attached to a beverage can according to principles of the invention.

In FIG. 18, the skirt 130 of the supplemental beverage container 100 releasably and securely engages the top rim a beverage can. As discussed above, the skirt 130 includes a divergent opening 155 and a snap-fit superior section 150. As shown in FIG. 8, the skirt 130 includes a shoulder 152 configured to engage the top rim 305 of a conventional beverage can 300. The skirt 130 is flexible and resilient. The snap-fit superior section 150 is sized and configured to snugly receive the top rim 305 of a beverage can 300. When urged on top of a beverage can 300, the skirt 130, including the shoulder 152, flex outwardly until the rim 305 of the can is received in the snap-fit superior section 150. When received by the snap-fit superior section 150, the rim 305 is securely engaged by the skirt 130. The material of the skirt 130 is supple, pliant and adaptable, to a secure seal when the rim 305 is received by the snap-fit superior section 150. An exemplary material may comprise silicone, other rubber-like elastomers, or other supple and resilient plastics.

In use, the supplemental beverage container 100 may be attached or re-attached to the top of a can 300 after the can 300 is opened. Then the lid 105 and seal 175 may be removed from the supplemental beverage container 100. Then the primary beverage in the can 300 and the supplemental liquid in the supplemental beverage container 100 may be poured and mixed simultaneously. The apertures 245 are sized, shaped and positioned to meter the supplemental liquid in a desired proportion to the primary beverage. The vent tube and port prevent a vacuum from impeding flow of the supplemental liquid.

Figure 19:
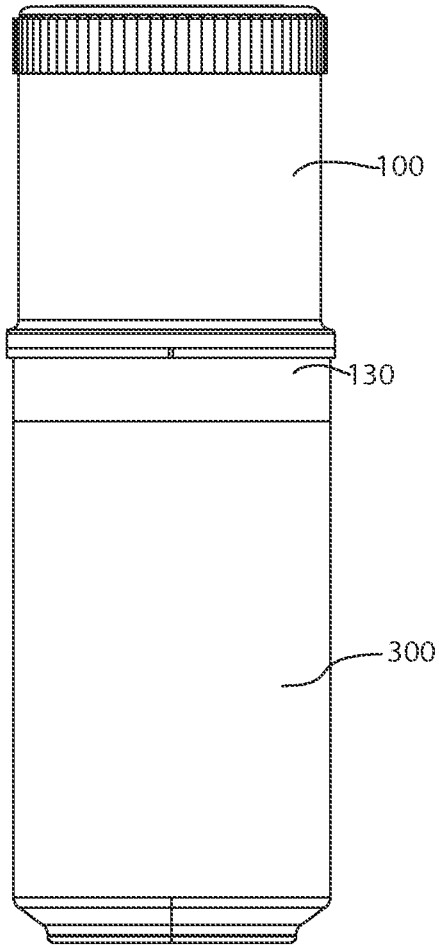
FIG. 19 provides a side view of another exemplary supplemental beverage container attached to a beverage can according to principles of the invention.

Referring now to FIG. 19, a side view of another exemplary supplemental beverage container 100 attached to a beverage can 300 according to principles of the invention is provided. In this embodiment, the supplemental beverage container 100 is sized and configured to more closely resemble an extension of the can 300.

Figure 20:
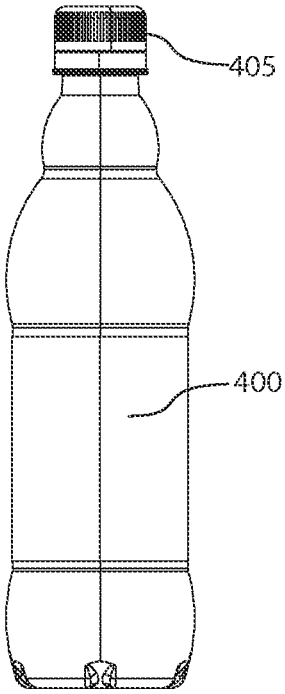
FIG. 20 provides a side view of an exemplary beverage bottle for use with a supplemental beverage container according to principles of the invention.
Figure 21:
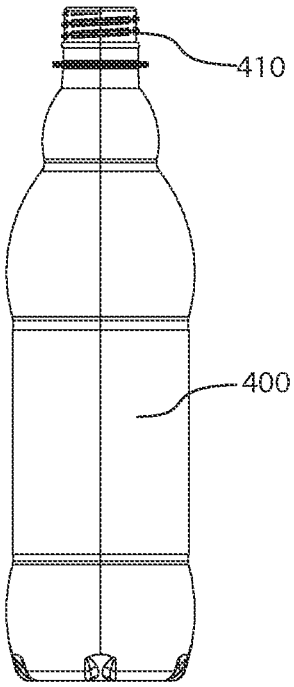
FIG. 21 provides a side view of an exemplary beverage bottle without a cap for use with a supplemental beverage container according to principles of the invention.
Figure 22:
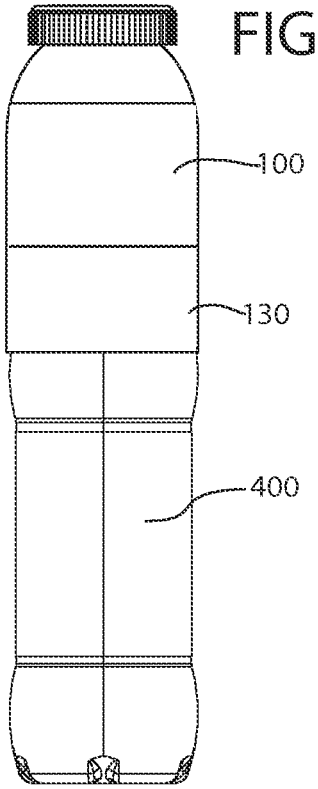
FIG. 22 provides a side view of an exemplary beverage bottle with a supplemental beverage container according to principles of the invention.

FIGS. 20 and 21 provide a side view of an exemplary beverage bottle 400 for use with a supplemental beverage container according to principles of the invention. In FIG. 20, a threaded cap 405 covers the neck of the bottle 400. In FIG. 21, the threaded neck 410 of the bottle 400 is exposed. Thus, the invention is not limited to use with a can. The skirt portion 130 of the supplemental beverage container 100 may have female threads designed to threadedly engage the threaded neck of a bottle 400, instead of snap-fitting to the top of a can, as illustrated in FIG. 22.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A supplemental beverage container comprising:

a body defining an interior compartment for containing a supplemental liquid, said body having a top, a bottom and a sidewall extending from the top to the bottom;

a top opening at the top of the body, a bottom opening at the bottom of the body, and a conduit extending from the bottom opening at the bottom of the body to the top opening at the top of the body, said conduit defining a fluid flow path from the bottom opening at the bottom of the body to the top opening at the top of the body;

a container attachment at the bottom of the body, said container attachment configured to removably attach the supplemental beverage container to a primary beverage container;

said opening at the bottom of the body being in fluid communication with the primary beverage container when the primary beverage container is opened and attached to the supplemental beverage container;

an aperture in the conduit, said aperture providing fluid communication between the interior compartment of the supplemental beverage container and the conduit;

a vent port in the body, said vent port providing venting for the interior compartment, said vent port comprising a vent opening in the top of the body, and top of the body including a threaded collar and a removable threaded cap, said cap threadedly engaging the threaded collar when attached to the collar, and said cap securing the first portion of the removable seal in the conduit and on the aperture and the second portion of the removable on the vent port, when the cap is attached to the collar; and a removable seal having a first portion configured to extend into the conduit and cover the aperture, said removable seal further comprising a second portion configured to extend to and cover the vent port, said removable seal comprising an elastomeric gasket.

2. A supplemental beverage container according to claim 1, said vent port comprising a vent opening in the top of the body.

3. A supplemental beverage container according to claim 1, further comprising a vent tube having a first end and an opposite second end, the first end being attached to the vent port, the second end being in the interior compartment.

4. A supplemental beverage container according to claim 3, said second end of the vent tube being adjacent to the bottom of the body in the interior compartment.

5. A supplemental beverage container according to claim 1, further comprising a sealable fill port in the body.

6. A supplemental beverage container according to claim 5, said sealable fill port being a sealable aperture in the bottom of the bottom of the body, and said fill port providing a fluid pathway into the interior compartment.

7. A supplemental beverage container according to claim 1, further comprising a guide pin extending from the bottom of the body outside of the interior compartment, said pin being configured to engage an opening in the primary container.

8. A supplemental beverage container according to claim 1, said primary beverage container comprising a beverage can with a top rim, and said container attachment of the supplemental beverage container at the bottom of the body comprising a flexible skirt having a divergent opening and a snap-fit superior section with a shoulder configured to engage the top rim of the beverage can.

9. A supplemental beverage container according to claim 1, said primary beverage container comprising a beverage bottle with a top threaded neck, and said container attachment of the supplemental beverage container at the bottom of the body comprising a threaded female opening configured to threadedly receive and engage the top threaded neck of the beverage bottle.

10. A supplemental beverage container according to claim 1, said aperture in the conduit being sized to regulate fluid flow through said aperture to achieve a determined flow rate.

11. A supplemental beverage container according to claim 1, said aperture in the conduit being one of a plurality of apertures in the conduit, each of said plurality of apertures providing fluid communication between the interior compartment of the supplemental beverage container and the conduit.

12. A supplemental beverage container according to claim 11, said plurality of apertures being sized to regulate fluid flow through said aperture to achieve a determined flow rate.

13. A supplemental beverage container comprising:

a container with an interior compartment for containing a supplemental liquid, said container having a top, an open bottom and a sidewall extending from the top to the open bottom, and a top opening at the top of the body;

a base assembly attached to container, said base assembly covering the open bottom of the container, a bottom opening in the base assembly, and a conduit extending from the bottom opening to the top opening at the top of the body, said conduit defining a fluid flow path from the bottom opening to the top opening at the top of the body;

a container attachment attached to the base assembly, said container attachment configured to removably attach the base assembly to a primary beverage container;

said bottom opening being in fluid communication with the primary beverage container when the primary beverage container is opened and attached to the base assembly;

an aperture in the conduit, said aperture providing fluid communication between the interior compartment of the supplemental beverage container and the conduit;

a vent port in the body, said vent port providing venting for the interior compartment; and a vent tube having a first end and an opposite second end, the first end being attached to the vent port, the second end being in the interior compartment adjacent to the base assembly;

a sealable fill port in the base assembly, said fill port providing a fluid pathway into the interior compartment;

a removable seal having a first portion configured to extend into the conduit and cover the aperture and a second portion configured to extend to and cover the vent port, said removable seal comprising an elastomeric gasket and the top of the body including a threaded collar and a removable threaded cap, said cap threadedly engaging the threaded collar when attached to the collar, and said cap securing the first portion of the removable seal in the conduit and on the aperture and the second portion of the removable on the vent port, when the cap is attached to the collar.

14. A supplemental beverage container according to claim 13, said aperture in the conduit being sized to regulate fluid flow through said aperture to achieve a determined flow rate.

* * * * *